US007160608B2

(12) United States Patent
Yanagisawa et al.

(10) Patent No.: US 7,160,608 B2
(45) Date of Patent: Jan. 9, 2007

(54) COATED PAPER

(75) Inventors: Kenji Yanagisawa, Amagasaki (JP); Tomofumi Tokiyoshi, Yokohama (JP); Masayuki Yamamoto, Yokohama (JP); Shigeru Nagashima, Tokyo (JP)

(73) Assignee: Oji Paper Co., Ltd., Tokyo (JP)

( * ) Notice: Subject to any disclaimer, the term of this patent is extended or adjusted under 35 U.S.C. 154(b) by 41 days.

(21) Appl. No.: 10/875,956

(22) Filed: Jun. 25, 2004

(65) Prior Publication Data

US 2004/0265542 A1 Dec. 30, 2004

(30) Foreign Application Priority Data

Jun. 30, 2003 (JP) ..... 2003-188354

(51) Int. Cl.
*B32B 5/16* (2006.01)
*B41M 5/00* (2006.01)

(52) U.S. Cl. ..... 428/324; 428/32.17; 428/32.33; 428/32.34; 428/33.37; 428/327

(58) Field of Classification Search ..... 428/32.17, 428/32.34, 155, 172, 204, 211, 324, 327, 428/328, 330, 331, 363, 32.33, 32.37, 206, 428/207

See application file for complete search history.

(56) References Cited

U.S. PATENT DOCUMENTS

| | | | | |
|---|---|---|---|---|
| 3,769,063 | A | | 10/1973 | Kizawa |
| 4,481,244 | A | | 11/1984 | Haruta et al. |
| 4,496,629 | A | | 1/1985 | Haruta et al. |
| 4,544,580 | A | * | 10/1985 | Haruta et al. ..... 427/261 |
| 5,853,870 | A | | 12/1998 | Uchimura et al. |

FOREIGN PATENT DOCUMENTS

| | | |
|---|---|---|
| EP | 0 430 391 A | 6/1991 |
| EP | 0 726 163 A | 8/1996 |
| GB | 1072303 | 6/1967 |
| JP | 59-022683 | 2/1984 |
| JP | 05-247891 | 9/1993 |
| JP | 06-025996 | 2/1994 |
| JP | 08-158297 | 6/1996 |

(Continued)

OTHER PUBLICATIONS

Database WPI, Section Ch, Week 198411, Derwent Publications Ltd., London, GB & JP 59 022683 A (Feb. 4, 1984) * abstract *.

(Continued)

*Primary Examiner*—Donald J. Loney
(74) *Attorney, Agent, or Firm*—Armstrong, Kratz, Quintos, Hanson & Brooks, LLP.

(57) ABSTRACT

A coated paper comprised of a paper substrate, at least one surface of which is provided with at least one coating layer, characterized in that the surface of said coating layer has cracks of a width of 0.2 to 3.0 μm and a length of 3 to 1000 μm in an amount of 1 to 1000 cracks per $mm^2$ is provided. In another embodiment, a coated paper comprised of a paper substrate, at least one surface of which is provided with at least two coating layers, characterized in that an inner coating layer adjoining said paper substrate comprises a pigment having a crystal structure selected from the group consisting of acicular crystal, spindle-shape crystal, columnar crystal, and rice-shape granulated crystal, and starches, and an outermost coating layer formed on said inner coating layer comprises crack formation promoting particles and a styrene-butadiene copolymer having a glass transition temperature of 20 to 150° C. is provided.

21 Claims, 1 Drawing Sheet

FOREIGN PATENT DOCUMENTS

| | | |
|---|---|---|
| JP | 09-324395 | 12/1997 |
| JP | 11-160906 | 6/1999 |
| JP | 2000-226791 | 8/2000 |

OTHER PUBLICATIONS

Database WPI, Section Ch, Week 199809, Derwent Publications ltd., London, GB & JP 09 324395 A (Dec. 16, 1997) * abstract *.
Database WPI, Section Ch, Week 198814, Derwent Publications Ltd., London, GB & JP 63 047700 A * abstract *.

European Search Report for corresponding European Patent Application No. 06075147, dated Apr. 11, 2006. (Citing references AA, AF & AK.).

Terao, T., et al.: "Effect of Porous Structure of Coated Layer on Ink Setting;" *Japan TAPPI Journal*, vol. 51, No. 9, Sep. 1997, pp. 79-85.

* cited by examiner

COATED PAPER

FIELD OF THE INVENTION

The present invention relates to a coated paper, more particularly relates to a coated paper enabling effective suppression of the occurrence of blisters during printing and having a good printing finish.

PRIOR ART

Rotary offset printing process, a type of printing process used for commercial printing, comprises the steps of feeding a roll of printing paper, transferring ink to the paper, drying the ink by a drier, and then again rolling up the paper. Further, a folding machine may be used to fold the paper. In either case, if the ink on the surface of the paper emerging from the drier is not completely dry, the surface of the coated paper or the printing press will become stained, and therefore a drier set to an extremely high temperature condition is used. At this time, however, the paper will occasionally suffer from the defects called "blisters".

The occurrence of blisters in such a rotary offset printing (called "paper blisters") is a phenomenon where an increase in the vapor pressure due to a rapid vaporization of moisture within the paper causes a force to act on the paper in the thickness direction and forms interlayer voids due to splitting of the layers in the paper. The failure of the moisture in the paper to smoothly dissipate is said to be the cause. Therefore, blisters tend to occur in printing paper having coating layers inferior in air permeability through its front and back sides. Along with the increasing faster printing speeds of recent years, drying temperatures have tended to become higher, and thus suppression of the occurrence of blisters has become more difficult. In particular, high-glossiness printing paper obtained through a gloss imparting step by supercalendering has further densified the structure of the coating layers, resulting in coating layers more inferior in air permeability, on which blisters tend to occur particularly.

Various proposals have been made to suppress the occurrence of blisters in rotary offset printing. These may be roughly divided into two methods: the first being the method of increasing the ply bond strength of the paper substrate of the coated paper (hereinafter described as the "base paper" in some cases) so as to provide resistance to swelling due to water vapor pressure and to prevent interlayer splitting, and the second being the method of improving the air permeability of the coating layer so as to enable the water vapor produced to escape and reduce the vapor pressure.

Various proposals have been made to improve the ply bond strength of the base paper. For example, a method of designing the ply bond strength of the base paper at or higher than a specific value (for example, see Japanese Unexamined Patent Publication (Kokai) No. 11-160906), a method of incorporating in the base paper a cationized starch and polyacrylamide in specific amounts (for example, see Japanese Unexamined Patent Publication (Kokai) No. 6-25996), etc. have been proposed and been put into practical use. However, with the above technique of increasing the ply bond strength of the base paper, when the air permeability of the coating layers formed on the base paper is high, the dissipation of the water vapor is greatly inhibited by the coating layers, so the occurrence of blisters cannot be completely suppressed just by improvement of the ply bond strength of the base paper.

Further, various methods for improving the air permeability of the coating layers have been proposed. Illustrative methods include, a method of using a latex comprising a base coating layer and a top coating layer wherein the base coat has a specific gel content (for example, see Japanese Unexamined Patent Publication (Kokai) No. 9-324395), a method of using a specific pigment and binder, which method comprises a treatment of the surface by roughened rolls (for example, see Japanese Unexamined Patent Publication (Kokai) No. 5-247891), a method of coating latexes with different glass transition temperatures (hereinafter referred to as "Tg") on the paper substrate or on a base coating layer (for example, see Japanese Unexamined Patent Publication (Kokai) No. 59-22683), a method of using kaolin having a specific aspect ratio (for example, see Japanese Unexamined Patent Publication (Kokai) No. 2000-226791), a method of using superheated water vapor etc. for drying a coating layer containing a high-Tg latex (for example, see Japanese Unexamined Patent Publication (Kokai) No. 8-158297), or the like. However, when there are plurality of coating layers, the thickness of the coating layers increases, so the desired air permeability is difficult to achieve. In addition, since plurality of coating steps are involved, the production cost becomes higher. Further, in the case of roughening, a high-glossiness coated paper cannot be obtained. Further, in the course of carrying out coating of latexes with different Tg's onto the paper substrate or the base coating layer, it is necessary to control the drying conditions within a specific range. Stable production, therefore, is difficult to accomplish and, due to the coating of only latexes, the coating layer becomes inferior in moisture absorption and tackiness when being subjected to printing. Moreover, use of kaolin having a specific aspect ratio limits the glossiness to be achieved. Also, with the method of using superheated water vapor etc. for drying coating layers containing high-Tg latex, the ink dryability, called the "ink set", in lithography, a main type of printing for commercial printing, becomes extremely slow. When there is no drying step in the printing process, the printing work efficiency drops significantly, the printed matters will be stained with undried ink, and the printing finish will be liable to decline. In this way, while advantageous effects are seen in each case, these methods cannot necessarily be said to have reached a sufficient level as methods with good printing finish and respond to the increasing faster printing speeds of recent years.

Further, with the printing method by a toner transfer system (so-called "electrophotographic printing"), a type of on-demand printing coming under attention in recent years, the occurrence of blisters again becomes a problem in some cases. There are two types of blisters in the toner transfer system: One, like the blisters in the rotary offset printing, is called paper blister which occurs when the moisture in paper evaporates to produce vapor pressure causing the paper to separate in layers. The other is called toner blister which occurs when the solid toner transferred to the paper melts and solidifies at the heat fixing part. In this situation, the air in the toner cannot pass through the coating layers, thereby has to escape from the smoothened surface of the toner layer. It is difficult to eliminate the toner blisters distinctive to the toner transfer systems by the method employed for suppressing blisters in rotary offset printing. No effective method for solving this problem has yet been found.

As the voids present at the surface of coating layers of general coated paper, there are three types: fine voids between pigment particles not buried by other components (hereinafter referred to as "pores A"), vapor-penetrating holes occurring in the drying step of coating layers (hereinafter referred to as "pores B"), and fractures in the coating occurring by the inability to withstand the tensile stress caused by film shrinkage at the time of drying due to the brittleness of the films of the coating layers (hereinafter referred to as "cracks"). For fixing ink on paper at the time of printing (so-called "ink set"), absorption of the ink solvent due to the capillary phenomenon of the pores etc. plays an extremely important role. The size of the pores A differ depending on the size of the pigment used, but normally is 0.02 to 0.2 μm or so, and contributes greatly to the ink set. Note that there are reports that the pores most effective for ink set have a size of 0.12 to 0.15 μm (for example, see Tomoyuki Terao et al., "Effects of Coating layer Structure of Coated Paper on Ink Set", *Japan TAPPI Journal,* vol. 51, no. 9, pp. 78 to 85 (September 1997).). Regarding pores B, it is extremely difficult to control their occurrence. Sometimes circular holes occur in a size capable of being visually discerned on white paper or printed matter. Therefore, suppression of the occurrence of cracks is generally desired in the production of coated paper. Cracks usually reduce the surface strength of coating layers, and therefore attempts have been made to suppress them as much as possible. It has been reported that the method of using latexes with different glass transition temperatures (for example, see Japanese Unexamined Patent Publication (Kokai) No. 59-22683) results in cracks at the surfaces of the coating layers, but as explained above, reproductive production is difficult and the sizes of the cracks at the front surfaces of the coating layers obtained are estimated to be the sizes for improving the ink set proposed in Japanese Unexamined Patent Publication (Kokai) No. 59-22683, that is, 0.02 to 0.20 μm. Up until now, effectively and stably causing the generation of voids of a size of at least 0.2 μm defined in the present invention has never been proposed.

In the above way, with the prior art, control of the voids present at the surface of the coating layers was difficult, so a satisfactory coated paper suppressing the occurrence of blisters in rotary offset printing and the occurrence of paper blisters and toner blisters in the electrophotographic printing could not be obtained. Further improvement has therefore been desired.

DISCLOSURE OF THE INVENTION

The present invention has as its object, the provision of a coated paper excellent in air permeability and free from the occurrence of blisters when being subjected to rotary offset printing or to electrophotographic printing. Further, it has as its object, the provision of a coated paper with a good ink set at the time of lithography and with a good printing finish. Further, it has as its object, the provision of a coated paper resistant to offset rotary wrinkles and excellent in folding crack resistance.

The inventors engaged in intensive studies considering this situation and as a result, in the first aspect, discovered that causing the occurrence of a specific number of cracks of a specific size at the surface of the coating layers is effective for suppressing the occurrence of blisters without sacrificing the printing effect. Further, they discovered that as the means for causing the occurrence of a specific number of cracks at the surface of the coating layers, inclusion of specific ingredients in the coating color forming the coating layers is particularly effective.

Accordingly, as the first aspect, the present invention provide the following embodiments:

(1) A coated paper comprised of a paper substrate, at least one surface of which is provided with at least one coating layer, characterized in that the surface of said coating layer has cracks of a width of 0.2 to 3.0 μm and a length of 3 to 1000 μm in an amount of 1 to 1000 cracks per $mm^2$.

(2) The coated paper of (1), wherein said surface of said coating layer has a white paper glossiness of 45 to 85% at a light-incident and receipt angle of 75 degrees in accordance with JIS Z 8741 and an Oken type air permeability of not more than 8000 sec. in accordance with the JAPAN TAPPI Pulp and Paper Testing Method No. 5-2:2000.

(3) The coated paper of (1) or (2), wherein said coating layer contains thermoplastic organic microparticles having a glass transition temperature of 20 to 150° C.

(4) The coated paper of (3), wherein 100 parts by mass of said coating layer contains 40 to 90 parts by mass of an inorganic pigment and 5 to 60 parts by mass of said thermoplastic organic microparticles.

(5) The coated paper according to any one of (1) to (4), wherein said coating layer contains crack formation promoting particles of an average particle size of 3.0 to 30.0 μm.

(6) The coated paper of (5), wherein 100 parts by mass of said coating layer contains 0.1 to 10 parts by mass of said crack formation promoting particles.

(7) The coating paper of (1) which comprises more than one coating layers, said layers comprise at least an inner coating layer adjoining said paper substrate and an outermost coating layer formed on said inner coating layer.

(8) The coating paper of (7), wherein said outermost coating layer contains 1 to 20 parts by mass of a non-film-forming hollow organic pigment in 100 parts by mass of the total pigment.

(9) The coated paper of (7) or (8), wherein said outermost coating layer contains crack formation promoting particles of an average particle size of 3.0 to 30.0 μm.

(10) The coating paper of (9), wherein 100 parts by mass of said outermost coating layer contains 0.1 to 10 parts by mass of said crack formation promoting particles.

(11) The coated paper of any one of (7) to (10), wherein 100 parts by mass of said outermost coating layer contains 40 to 90 parts by mass of inorganic pigment and 5 to 60 parts by mass of thermoplastic organic microparticles.

(12) The coated paper of (11), wherein said thermoplastic organic microparticles have a glass transition temperature of 20 to 150° C.

(13) The coated paper of (11) or (12), wherein said thermoplastic organic microparticles comprise a styrene-butadiene copolymer.

(14) The coated paper of (7), wherein said inner coating layer contains a pigment having a crystal structure selected from the group consisting of acicular crystal, spindle-shape crystal, columnar crystal, and rice-shape granulated crystal.

(15) The coated paper of (7), wherein said inner coating layer contains starches.

As a result of the inventors' further intensive studies concerning the situation mentioned above, in the second aspect, they discovered that providing a coated paper comprised of a paper substrate, at least one surface of which is provided with at least two coating layers, characterized in that an inner coating layer adjoining the paper substrate comprises a pigment having a specific crystal structure and starch, and an outermost coating layer formed on the inner coating layer comprises crack formation promoting particles and a styrene-butadiene copolymer having a specific glass transition temperature are particularly effective.

Accordingly, as the second aspect, the present invention provide the following embodiments:

(16) A coated paper comprised of a paper substrate, at least one surface of which is provided with at least two coating layers, characterized in that an inner coating layer adjoining said paper substrate comprises a pigment having a crystal structure selected from the group consisting of acicular crystal, spindle-shape crystal, columnar crystal, and rice-shape granulated crystal, and an outermost coating layer formed on said inner coating layer comprises thermoplastic organic microparticles having a glass transition temperature of 20 to 150° C.

(17) The coated paper of (16), wherein said inner coating layer contains starches.

(18) The coated paper of (16), wherein said thermoplastic organic microparticles comprise a styrene-butadiene copolymer.

(19) The coated paper of (16), wherein said thermoplastic organic particle contains a non-film-forming hollow organic pigment, and 100 parts by mass of the total pigment of said outermost coating layer contains 1 to 10 parts by mass of said non-film-forming hollow organic pigment.

(20) The coated paper of (16), wherein said outermost coating layer comprises crack formation promoting particles.

(21) The coated paper of (20), wherein said crack formation promoting particles have an average particle size of 3.0 to 30.0 μm and are contained in an amount of 0.1 to 10 parts by mass in 100 parts by mass of said outermost coating layer.

(22) The coated paper of any one of (16) to (21), wherein 100 parts by mass of said outermost coating layer contains 40 to 90 parts by mass of the inorganic pigment and 5 to 60 parts by mass of the thermoplastic organic microparticles.

(23) The coated paper of any one of (16) to (22), wherein said outermost coating layer surface has cracks of a width of 0.2 to 3.0 μm and a length of 3 to 1000 μm in an amount of 1 to 1000 cracks per $mm^2$.

(24) The coated paper of any one of (16) to (23), wherein said outermost coating layer surface has a white paper glossiness of 45 to 85% at a light-incident and receipt angle of 75 degrees in accordance with JIS Z 8741 and an Oken type air permeability of not more than 8000 sec. in accordance with the Japan TAPPI Pulp and Paper Testing Method No. 5-2:2000

The coated paper according to the present invention is free from occurrence of blisters in the rotary offset printing and the electrophotographic printing, excellent printing finish is accomplished, and further is free from rotary offset wrinkles, free from folding cracks, and extremely useful in practice.

BEST MODE FOR CARRYING OUT THE INVENTION

Figure 1A:
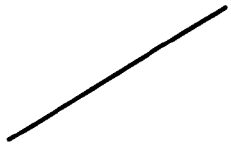
FIGS. 1(*a*)–1(*c*) shows shape 1 of cracks.

The inventors engaged in repeated intensive studies regarding the suppression of the occurrences of blisters at offset printing and the electrophotographic printing, and as a result, discovered that by providing to the coating layers, cracks of a width of 0.2 to 3.0 μm and a length of 3 to 1000 μm in an amount of 1 to 1,000 cracks per $mm^2$, it is possible to improve the paper without impairing other properties.

The reason why the coated paper obtained in this embodiment is extremely effective for suppression of occurrence of blisters is believed to be as follows. That is, it is believed that the cracks at the surface of a coating layer differ from the cracks occurring in the general production of coated paper in that they are larger in size and greater in number, so the water vapor and air effectively dissipate, and the occurrence of blisters in the course of rotary offset printing or electrophotographic printing can be remarkably suppressed.

As a result of the inventors' further intensive studies regarding the suppression of blisters at the time of rotary offset printing and the suppression of blisters in the electrophotographic printing, they also discovered that by providing a coated paper comprised of a paper substrate, at least one surface of which is provided with at least two coating layers, characterized in that an inner coating layer adjoining the paper substrate comprises a pigment having a specific crystal structure and starch, and an outermost coating layer formed on the inner coating layer comprises crack formation promoting particles and a styrene-butadiene copolymer having a specific glass transition temperature, improvement was possible without impairing other properties.

The reason why the coated paper obtained in the above embodiment is extremely effective for suppression of occurrence of blisters is believed to be as follows. That is, it is believed that due to the existence of cracks at the surface of the outermost coating layer, which cracks differ from the cracks occurring in the general production of coated paper, and due to the inclusion of crack formation promoting particles and a styrene-butadiene copolymer having a specific glass transition temperature in the outermost coating layer, which provide cracks larger in size and greater in number, the water vapor and air effectively dissipate, and thus the occurrence of blisters at rotary offset printing or electrophotographic printing can be remarkably suppressed.

To suppress the occurrence of blisters, as explained above, cracks of a width of 0.2 to 3.0 μm and length of 3 to 1000 μm should be present in an amount of 1 to 1000 per $mm^2$. Note that when the number of cracks is less than 1 per $mm^2$, or when the width of the cracks is less than 0.2 μm, or when the length of the cracks is less than 3 μm, the effect of improvement of the air permeability becomes lower and the occurrence of blisters can no longer be effectively suppressed in some cases. Further, conversely, when the number of cracks exceeds 1000 per $mm^2$, or when the width of the cracks exceeds 3.0 μm, or when the length of the cracks exceeds 1000 μm, the printing strength is liable to decline. When the number of cracks is 5 to 500 per $mm^2$, the width of the cracks is 0.5 to 2.0 μm, and the length of the cracks is 10 to 500 μm, the balance between the improvement of the air permeability of the coating layers and the other aspects of quality is good, so this is most preferred.

When providing printing on the coated paper having the cracks defined in the present invention, visual discernment of the cracks on the printed matter will be extremely difficult and a good printing finish can be obtained.

Note that the cracks should not be connected and should be independent. If the cracks are connected, the printing strength will be inferior in some cases. This is not preferable.

Figure 1B:
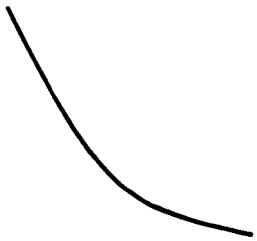
Figure 1C:
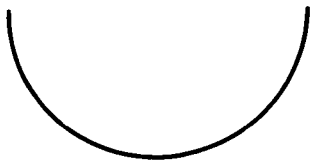
Figure 2D:
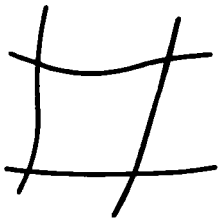
FIGS. 2(*d*)–2(*g*) shows shape 2 of cracks
Figure 2E:
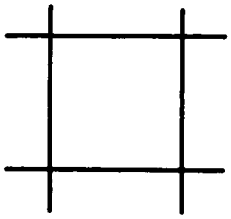
Figure 2F:
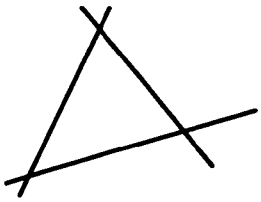
Figure 2G:
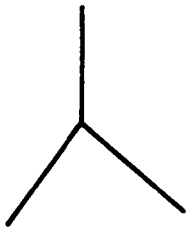

The amount of "cracks per $mm^2$" defined in the present invention indicates the total number of the cracks straight present on the surface of the coating layers per $mm^2$, which cracks can be straight, curved, semicircular, or other type of cracks present independently without branching etc. as shown in FIG. 1*a* to c, or can be cracks having combination shape such as net-shaped, lattice-shaped, triangular-shaped, arrow-shaped cracks as shown in FIG. 2*d* to *g*. Note that a crack of a combination shape is deemed and counted as a single crack.

The components of the coating layers of the present invention are not critical so long as the desired cracks can be obtained, but as preferable materials, thermoplastic organic microparticles can be mentioned. Among these, thermoplastic organic microparticles which soften at its surface or soften entirety under the coating and drying conditions are preferable. Among these, thermoplastic organic microparticles comprised of a resin having a film-forming temperature higher than the latex conventionally used as an adhesive for coated paper and a Tg (glass transition temperature) in the range of 20 to 150° C. are superior in terms of the occurrence of cracks, and therefore are preferable. Among these, in terms of the balance between the preferable occurrence effect of crack and the printing strength, ones with a Tg in the range of 20 to 80° C. are preferably, and ones with a Tg in the range of 30 to 80° C. are more preferable. When the Tg is less than 20° C., there is less occurrence of cracks as seen from the desired level, the air permeability becomes inferior, and the effect of suppression of blisters becomes inferior. When the Tg exceeds 150° C., a decline in the printing strength may occur under the common drying conditions, so this is not preferable.

In the present invention, rather than using alone one type of thermoplastic organic microparticles comprised of a resin having a Tg in the temperature range of 20 to 150° C., use of a combined system comprising two or more types of thermoplastic organic microparticles comprised of resins having Tg's in the range of 20 to 150° C. and differing in film-forming conditions is more preferable. For example, there may be a combination of thermoplastic organic microparticles having different Tg's or a combined system of thermoplastic organic microparticles having a single Tg and thermoplastic organic microparticles having a non-single Tg's (which may have two or more peaks or a broad peak). With a system using only one type of thermoplastic organic microparticles comprised of a resin having a Tg of 20 to 150° C., when the coated paper is produced under conditions where the inside of the drier of the coating machine is high in temperature and the amount of water vapor becomes large, the film formation will proceed all at once, the voids will be reduced, resulting in a coated paper with a slow ink set, and printing foul will tends to occur due to the undried ink after printing. However, the above combined system suppresses rapid progress in film-formation at the time of drying and results in the formation of good voids, so the air permeability is good and the paper has a good ink set. As thermoplastic organic microparticles having non-single Tg's (having two or more peaks or a broad peak), or ones having plurality of peaks determined by a Tg measuring device, the main peak of which is in the range of 20 to 150° C., ones having a broad peak, wherein at least 80% of the peak is in the range of 20 to 150° C., or ones having a Tg in the range of 20 to 150° C. calculated from each Tg of the composed monomers, are preferred. The mixing ratio of the plurality of thermoplastic organic microparticles may be set, in appropriate, in accordance with the quality design of the coated paper. As the thermoplastic organic microparticles used in the present invention, ordinary microparticles homogeneous as a whole, and also nonhomogeneous structure microparticles such as core/shell microparticles may be mentioned. In the case of core/shell microparticles, the Tg of the resin at the shell side is important and preferably is in the range of 20 to 150° C. However, although the performance of the obtained sheet may be inferior, it is possible to use one having a Tg less than 20° C. Specifically, ones called binder pigments may be mentioned.

As the thermoplastic organic microparticles, for example, polydienes such as polyisoprene, polyneoprene, polybutadiene, polyalkenes such as polybutene, polyisobutylene, polypropylene, polyethylene, vinyl-based polymers or copolymers such as vinyl halide, vinyl acetate, styrene, (meth)acrylic acid, (meth)acrylic acid esters, (meth)acrylamide, methylvinyl ether, synthetic rubber latexes such as styrene-butadiene based or methyl methacrylate-butadiene-based rubber latexes, polyurethane-based resins, polyester-based resins, polyamide-based resins, olefin-anhydrous maleic acid based resins, vinylidene chloride-based resins, etc. may be mentioned. One or two or more among these may be suitably selected and used.

As the amount of the thermoplastic organic microparticles blended into the coating color, a range of 5 to 60 parts by mass relative to 100 parts by mass (dried) of the coating layer is preferable. If the amount blended is less than 5 parts by mass, the occurrence of cracks cannot be promoted, the air permeability becomes higher, and the effect of suppression of occurrence of blisters becomes considerably inferior to the target. Further, if the amount blended exceeds 60 parts by mass, the resin ingredient of the coating layer will become greater, the ink vehicle absorption will become inferior, ink transfer defects will tend to occur, and the aesthetic property of the coated paper will decline, so this is not preferred.

The coating color of the present invention may contain a pigment as required in addition to the above thermoplastic organic microparticles. As the pigment, known inorganic pigments and organic pigments other than the above thermoplastic organic microparticles may be mentioned. As inorganic pigments, for example, minerals such as ground calcium carbonate, precipitated calcium carbonate, kaolin, calcined kaolin, structural kaolin, delaminated kaolin, talc, calcium sulfate, barium sulfate, titanium dioxide, zinc oxide, alumina, magnesium carbonate, magnesium oxide, silica, magnesium aluminosilicate, calcium silicate, white carbon, bentonite, zeolite, sericite, smectite may be mentioned. As organic pigments, for example, polystyrene-based resins, styrene-butadiene copolymer-based resins, styrene-acrylic copolymer-based resins, styrene-methacrylic copolymer-based resins, acrylic-based resins, vinylidene-chloride-based resins, urea-based resins, melamine-based resins, benzoguanamine-based resins, etc. may be mentioned. As organic pigments, solid types, hollow types, through hole types, and core/shell types may be mentioned. One or more types among these may be suitably selected for use. Among these, hollow organic pigments easily deform under pressure. By use of them, when imparting gloss in the supercalendering or other smoothing step, the desired glossiness can be obtained with a lower processing pressure, so the reduction in the pores of the coating layer is suppressed. Therefore, hollow organic pigments exhibiting a good air permeability are preferably used. Note that the amount of the hollow organic pigment blended into the coating color is preferably not more than 20 parts by mass relative to 100 parts by mass (dried) of the total pigment, more preferably 1 to 10 parts by mass. If over 20 parts by mass, sometimes calender burning or the phenomenon of a drop in opacity called blacking occur in the supercalendering or other smoothing step.

As the amount of said inorganic pigment blended into the coating color, a range of 40 to 90 parts by mass relative to 100 parts by mass of the coating layer (dried) is preferable. If the amount blended is less than 40 parts by mass, the occurrence of cracks cannot be promoted, the air permeability becomes higher, and the effect of suppression of blisters becomes considerably inferior. Further, if the amount blended exceeds 90 parts by mass, the surface strength becomes inferior and stable printing is not possible.

In particular, when using a coating color comprised of a range of 40 to 90 parts by mass of an inorganic pigment and a range of 5 to 60 parts by mass of thermoplastic organic microparticles, particularly good cracks are obtained, so this is preferable.

To the coating color used in the present invention, an adhesive and crack formation promoting particles are added, if necessary. The adhesive is used for increasing the surface strength of the coating layer and imparting good printing properties. Further, the crack formation promoting particles are added thereto, when the cracks are not formed to the desired level.

As the adhesive, a water soluble or water dispersing polymer compound can be used. For example, a cationic starch, amphoteric starch, oxidized starch, enzyme-modified starch, thermochemically-modified starch, esterified starch, etherified starch, or other starch, carboxymethylcellulose, hydroxyethylcellulose, or other cellulose derivatives, gelatin, casein, soybean protein, natural rubber, or other natural or semisynthetic polymer compounds, polyvinyl alcohol, isoprene, neoprene, polybutadiene, or other polydienes, polybutene, polyisobutylene, polypropylene, polyethylene, or other polyalkenes, vinyl halide, vinyl acetate, styrene, (meth)acrylic acid, (meth)acrylic acid esters, (meth)acrylamide, methylvinyl ethers, and other vinyl-based polymers or copolymers, styrene-butadiene-based, methyl methacrylate-butadiene-based, and other synthetic rubber latexes, polyurethane-based resins, polyester-based resins, polyamide-based resins, olefin-anhydrous maleic acid-based resins, melamine-based resins, and other synthetic polymer compounds may be mentioned. The adhesive may, in accordance with need, be one or two or more suitably selected. Among these adhesives, an adhesive having a Tg of not more than 20° C. is preferable, particularly preferably not more than 0° C. As the amount of the adhesive blended in the coating color, not more than 15 parts by mass relative to 100 parts by mass of the coating layer (dried) is preferable. If the amount blended is more than 15 parts by mass, the occurrence of cracks is inhibited and the desired effect of the present invention becomes hard to obtain. Note that as the adhesive, a latex having a core/shell structure can also be used. In this case, one having a Tg of the shell portion contributing to the film formation of not more than 20° C. is preferable. When using starch or another water soluble polymer compound as the adhesive, if the amount used becomes too great, the desired air permeability can no longer be obtained, so as the amount blended into the coating color, not more than 5 parts by mass, further not more than 2 parts by mass, is preferable.

The crack formation promoting particles are particles with an average particle size in the range of 3.0 to 30.0 μm having an effect of promoting crack formation. Particles in the range of 5.0 to 15.0 μm are particularly preferred. If the average particle size is less than 3.0 μm, the effect of the addition of the particles may be difficult to appear. If it exceeds 30.0 μm, sometimes problems such as ink transfer defects occur at the time of printing. The distribution of particle size of the crack formation promoting particles is preferably in a range of 1.0 to 50.0 μm. Further, as the crack formation promoting particles, spherically shaped crack formation promoting particles are preferable. The size of the crack formation promoting particles is particularly important. The material is not critical, but for example thermoplastic organic microparticles or pigments similar to the ones mentioned earlier may be mentioned. As the amount of crack formation promoting particles blended in the coating color, a range of 0.1 to 10 parts by mass relative to 100 parts by mass (dried) of the coating layer is preferable. If the amount blended is less than 0.1 part by mass, the effect of addition of the particles may be difficult to appear, while if it exceeds 10 parts by mass, inferiority in the printing strength is occurred in some cases.

The coating color used in the present invention may in accordance with need further suitably include various additives such as a surfactant, pH adjuster, viscosity modifier, water retention agent, softener, gloss agent, waxes, dispersant, fluidity modifier, anticonductivity agent, stabilizer, antistatic agent, cross-linking agent, sizing agent, fluorescent whitener, coloring agent, UV absorbent, antifoamer, waterproofing agent, plasticizer, preservative, fragrance, etc.

As the moisture retainer, carboxymethylcellulose, hydroxyethylcellulose, or another cellulose derivative or an alkaline-swelling type acrylic thickener or other synthetic water retention agent is preferably used.

The pulp forming the paper substrate used in the present invention is not critical with respect to its manufacturing process or its type, etc. Chemical pulp such as KP and SP, mechanical pulp such as SGP, RGP, BCTMP, and CTMP, chlorine-free pulp such as ECF pulp and TCF pulp, recycled paper pulp such as deinked pulp, nonwood pulp such as kenaf, bagasse, bamboo, straw, and hemp, organic synthetic fiber such as polyamide fiber, polyester fiber, polynosic fiber, inorganic fiber such as glass fiber, ceramic fiber, and carbon fiber, etc. may be mentioned.

The paper substrate may, in accordance with need, suitably include a filler, retention aid, drainage aid, paper strength additive, fixer, internal sizing agent, dye, fluorescent whitening agent, pH adjuster, antifoamer, pitch control agent, slime control agent, or other paper-making internal aids. Note that the filler is not critical, but various types of pigments generally used for wood free paper, for example, kaolin, calcined kaolin, calcium carbonate, calcium sulfate, barium sulfate, titanium dioxide, talc, zinc oxide, alumina, magnesium carbonate, magnesium oxide, silica, white carbon, bentonite, zeolite, sericite, smectite, and other mineral pigments, polystyrene-based resins, urea-based resins, melamine-based resins, acryl-based resins, vinylidene-chloride-based resins, and other organic pigment-based solid type, fine hollow type, and through hole type particles may be mentioned.

The method of making the paper substrate is not critical, but for example the acid paper-making method where the papermaking pH is near 4.5, the neutral paper-making method mainly using a neutral sizing agent and/or calcium carbonate or other alkali filler and carried out at a weak acid paper-making pH of about 6 to a weak alkaline paper-making pH of about 9, and any other paper-making methods may be used. As the paper-making machine, it is also possible to suitably use a paper-making machine known in the industry such as a fourdrinier paper machine, a twin wire paper machine, a cylinder net paper machine, a Yankee paper machine, or an inclined wire former.

The basis weight of the paper substrate used in the present invention is not particularly limited, but normally one in the range of 40 to 200 g/m$^2$ is preferably used.

The method of making the paper substrate is not critical. However, with a method resulting in good air permeability in the coating layer, but extremely poor air permeability in the paper substrate, the effect of suppressing occurrence of blisters may not be accomplished in some cases. Therefore, the air permeability of the paper substrate, in accordance with the Japan TAPPI Pulp and Paper Testing Method No. 5-2:2000, is preferably not more than 30 seconds, more preferable not more than 20 seconds.

The coating weight of the coating layer of the present invention is not critical, but may be 2 to 25 g/m$^2$ on the basis of dried weight with respect to one surface of the paper substrate, preferably 5 to 20 g/m$^2$. If the coating weight is less than 2 g/m$^2$, forming a coating layer on the paper substrate uniformly would become difficult. On the other hand, if it exceeds 25 g/m$^2$, occurrence of cracks will becomes difficult due to the shrinkage of the coating layer.

As the method of coating the coating layer, in general, a known coating apparatus, for example, a blade coater, air knife coater, roll coater, reverse roll coater, bar coater, curtain coater, slot die coater, gravure coater, champlex coater, brush coater, slide bead coater, twin roll type, or metering blade type size press coater, bill blade coater, short dowel coater, gate roll coater, etc. may be used. In view from the crack occurrence mechanism, rather than a contour coating method which provides uniform thickness of coating on the paper, a flat coating method which provides coverage over the relief shapes on the paper surface formed by the fibers and which makes them flat is preferable. When mixing thermoplastic organic microparticles in the coating color, drying is preferably performed under conditions where the paper surface temperature becomes higher than the Tg of the thermoplastic organic microparticles.

The coated paper of the present invention is normally treated to smooth it. The smoothing is performed by on-machine or off-machine processing using a supercalender, gloss calender, soft calender, or other known apparatus. The pressure, heating temperature, number of nips, and other processing conditions of the pressing apparatus are suitably adjusted. In the present invention, the size and the number of the occurring cracks are considerably larger than those normally seen in a general coated paper for printing, so the cracks are not blocked even by the gloss processing with the supercalender etc., and thus a good air permeability may be given.

Paper blisters and toner blisters in the electrophotographic printing can be reduced to the desired level by setting the Oken-type air permeability of the coated paper in accordance with the Japan TAPPI Pulp and Paper Testing Method No. 5-2:2000 not more than 8000 seconds. In particular, this should be not more than 5000 seconds, more preferably not more than 3000 seconds, more preferably not more than 2000 seconds.

In the present invention, with respect to the aesthetic property of the coated paper, a white paper glossiness of light-incident and receipt angle of 75 degrees in accordance with JIS Z 8741 in the range of 45 to 85% is preferable, and 55 to 85% is more preferable.

To obtain the coated paper with a high white paper glossiness at a light-incident and receipt angle of 75 degrees in accordance with JIS Z 8741, smoothening under high pressure conditions is required. With a general coated paper for printing, the pores may be blocked depending on the treatment, and only inferior air permeability can be obtained, but the coated paper according to the present invention is capable of achieving air permeability even with smoothening under high pressure conditions due to the existence of the cracks, and thus can suppress the occurrence of blisters.

The coated paper according to the present invention has a coating layer formed at both sides or one side of a paper substrate. At that time, the coating layer at the same side can, as needed, be made a multilayer structure of two or more layers. Note that in the case of two-sided coating or a multilayer structure, there is no need to make the individual coating colors the same or the same in the coating weight. They may be suitably adjusted and blended in accordance with the desired level of quality. Further, in the case of two-sided coating or a multilayer structure, there is no need to cause cracks of the present invention at all layers. The layers are designed so as to obtain the desired air permeability, surface strength, and glossiness.

When the coated paper according to the present invention is formed as a multilayer structure of two or more layers, normally it is sufficient that the outermost coating layer have the cracks according to the present invention.

Explaining the case where the coating layer according to the present invention is formed as a multilayer structure of two or more layers, the following may be said. That is, the coated paper according to the present invention has a coating layer having a multilayer structure of two or more layers including at least an inner coating layer adjoining the paper substrate and an outermost coating layer formed above the inner coating layer.

Here, the outermost coating layer preferably includes 1 to 20 parts by mass of a non-film-forming hollow organic pigment in 100 parts by mass of the total pigment, more preferably 1 to 10 parts by mass. Further, the outermost coating layer preferably contains crack formation promoting particles of an average particle size of 3.0 to 30.0 μm. The crack formation promoting particles are preferably contained in an amount of 0.1 to 10 parts by mass relative to 100 parts by mass of the outermost coating layer. For the crack formation promoting particles, those explained above may be preferably used.

Further, the outermost coating layer preferably contains 40 to 90 parts by mass of inorganic pigment and 5 to 60 parts by mass of thermoplastic organic microparticles in 100 parts by mass of the outermost coating layer. Here, for the inorganic pigments, the ones described above, such as ground calcium carbonate, precipitated calcium carbonate, kaolin, calcined kaolin, structural kaolin, delaminated kaolin, talc, calcium sulfate, barium sulfate, titanium dioxide, zinc oxide, alumina, magnesium carbonate, magnesium oxide, silica, magnesium aluminosilicate, calcium silicate, white carbon, bentonite, zeolite, sericite, smectite, and other minerals may be used. As for the thermoplastic organic microparticles, the ones described above, such as polyisoprene, polyneoprene, polybutadiene, and other polydienes, polybutene, polyisobutylene, polypropylene, polyethylene, and other polyalkenes, vinyl halide, vinyl acetate, styrene, (meth)acrylic acid, (meth)acrylic acid esters, (meth)acrylamide, methylvinyl ether, and other vinyl-based polymers or copolymers, styrene-butadiene based, methyl methacrylate-butadiene-based, and other synthetic rubber latexes, polyurethane-based resins, polyester-based resins, polyamide-based resins, olefin-anhydrous maleic acid based resins, vinylidene chloride-based resins, etc. may be used.

The thermoplastic organic microparticles preferably are ones having a glass transition temperature of 20 to 150° C. A styrene-butadiene copolymer is more preferable.

On the other hand, for the inner coating layer, a pigment having one kind of crystal structure of an acicular crystal, spindle-shape crystal, columnar crystal, and rice-shape granulated crystal is preferably used, and a starch is preferably incorporated.

The pigment having one kind of crystal structure of an acicular crystal, spindle-shape crystal, columnar crystal, and rice-shape granulated crystal is produced, for example, by the method of reacting suitable concentrations of a calcium hydroxide suspension and a carbonic acid gas containing gas in the presence of at least one of phosphoric acid or its water soluble salts (Japanese Examined Patent Publication (Kokoku) No. 57-30815), the method of reacting them in the presence of a specific carboxylic acid and its water soluble salts (Japanese Examined Patent Publication (Kokoku) No.

57-31530), the method of introducing into a specific acicular crystal nucleus calcium carbonate- and calcium hydroxide-containing suspension a carbonic acid gas-containing gas at a specific temperature to cause a carbonation reaction and obtaining a tied mass of acicular calcium carbonate (Japanese Examined Patent Publication (Kokoku) No. 59-232916), etc.

These pigments are fine particle pigments having a crystal structure selected from the group consisting of an acicular crystal, spindle-shape crystal, columnar crystal, and rice-shape granulated crystal having average dimensions observed through an electron microscope of a short axis dimension (W) of 0.005 to 0.5 μm, a long axis dimension (L) of 0.1 to 10 μm, and an aspect ratio (L/W) of 2 to 1000 and may be suitably selected and used.

The coating weights of the inner and the outermost coating layers are not critical. However, the weight of the inner coating layer may be 0.1 to 10 g/m$^2$ on the basis of dried weight with respect to one surface of the paper substrate, preferably 0.5 to 5 g/m$^2$. If the coating weight is less than 0.1 g/m$^2$, the effect resulted from the use of two coating layers will become extremely small, and on the other hand, if it exceeds 10 g/m$^2$, the air permeability will become high. Regarding the outermost coating layer, its weight may be 2 to 25 g/m$^2$ on the basis of dried weight with respect to one surface of the paper substrate, preferably 5 to 25 g/m$^2$. If the coating weight is less than 2 g/m$^2$, forming a uniform coating layer will be difficult, resulting in difficulty in the obtainment of high glossiness. On the other hand, if it exceeds 25 g/m$^2$, occurrence of cracks will become difficult.

Further, when providing the above coating layer on one surface of the paper substrate, it is possible to provide a coating layer on the back surface for preventing curling, imparting printability, imparting paper feedability, imparting an antistatic property, etc. Further, it is possible to subject the back surface to a post-treatment so as to impart tackiness, thermal recording, magnetic recording, flame retardance, heat resistance, water-proofing, oil resistance, antislip, and other properties. In addition, it is possible to subject it to post-treatment so as to form a thermal transfer layer, ink jet recording layer, etc.

The moisture of the coated paper of the present invention is usually adjusted to a range of 3 to 10%. More preferably it is in the range of 4 to 8%. When the moisture is less than 3%, the paper suffers from curling and cannot be printed on stably. If the moisture exceeds 10%, blisters occur extremely easily.

The coated paper obtained in the present invention has extremely good performance as a paper used for the rotary offset printing or electrophotographic printing, but can also be used as an image recording paper for the thermal transfer recording, ink jet recording, etc.

In particular, with the electrophotographic printing where the image is formed by toner particles of about 5 to 7 μm, it is possible to obtain an extremely high-grade image by use of the above coated sheet.

For example, when using an electrophotographic type printer to form and evaluate an image based on the method according to the ISO-13660 Draft Standard QEA (Quality Engineering Associates Inc.), the mottle at a tile size of 40 μm would be not more than 10 GSV (Grey Scale Value), the raggedness of the lines would be not more than 10 μm, and the blurriness would be not more than 11 μm, i.e., it is possible to obtain an extremely good image.

The coated paper of the present invention is further resistant to rotary offset printing wrinkles and superior in folding crack resistance. Here, the "rotary offset printing wrinkles" means wrinkles in the paper which are formed during the rotary offset printing, while the "folding crack resistance" means the resistance to occurrence of fractures of the printed portions on the peak or the valley regions of the fold made by folding the paper which has finished the rotary offset printing. The reason for the resistance to occurrence of rotary offset printing wrinkles is believed to be that the air permeability of the coated paper according to the present invention is low, so the evaporation of the moisture contained in the drying process of the rotary offset printing occurs uniformly, and therefore no variation occurs in the paper moisture and, as a result, the paper is not strained and wrinkles are hard to form. Further, as the reason for the superior folding crack resistance, it may be considered that despite the coated paper according to the present invention being low in air permeability, the surface strength of the coating layers is strong and even if a force is applied at the time of folding, the coating layers will not be destroyed and, as a result, fractures will not easily occur at the higher printed locations. Note that to prevent rotary offset printing wrinkles or to improve the folding crack resistance, a system further including a binder and a binder pigment gives particularly good results.

EXAMPLES

Next, the present invention will be explained in more detail with examples, but the present invention is not limited to these scopes. Note that the "parts" and "%" in the examples are "parts by mass (solids)" and "wt %" unless otherwise indicated. Further, when the measured Tg is not a single peak, the main peak temperature or the Tg calculated from the monomer composition is indicated as the "representative Tg value". When the measured Tg is a single peak, its measured value or the Tg calculated from the monomer composition is indicated as the "Tg value".

Example 1

[Preparation of Paper Substrate]

5 parts of precipitated calcium carbonate (PC, made by Shiraishi Calcium), 1.5 parts of starch, 0.1 part of alkenyl anhydrous succinic acid, and 0.6 part of aluminum sulfate were added to a pulp slurry of 90 parts of LBKP (Freeness (CSF)=450 ml) and 10 parts of NBKP (Freeness (CSF)=450 ml) to prepare a paper stock. Next, this paper stock was used to make paper by a fourdrinier paper machine. In the paper-making process, a size press device was used to coat starch to a dried mass of 1 g/m$^2$, then a machine calender was used to smooth the paper to a Bekk smoothness of 30 seconds, to thereby obtain a paper substrate having a basis weight of 60 g/m$^2$.

[Preparation of Coating Color]

5 parts of kaolin (product name: Mirror-Gloss 91, made by Engelhard Corporation) and 0.01 part of a dispersant (product name: Alon-A-9, made by Toa Gosei Corporation) were added to water and dispersed by a Cowles disperser to obtain a kaolin dispersion in a solids concentration of 72%. 65 parts, by solids content, of 75% solids concentration ground calcium carbonate (product name: FMT-97, made by Fimatec Ltd.) was added to this dispersion to prepare a pigment slurry. 0.3 part of carboxymethylcellulose (product name: AG gum HE No. 2, made by Daiichi Kogyo Seiyaku Co., Ltd.), 10 parts thermoplastic organic microparticles comprised of a styrene-butadiene-based copolymer with a Tg of 35° C. (product name: POT-7092, made by Nippon Zeon), and 20 parts of thermoplastic organic microparticles with a Tg of 55° C. (product name: 0640, made by JSR) were added to and mixed with this pigment slurry, and then water was added to prepare a coating color with a solids concentration of 55%.

[Formation of Coating Layers]

The above coating color was coated on both surfaces of a paper substrate using a blade coater at a coating rate of 500 m/min so as to give a dried coating weight per side of 12 g/m$^2$. The hot air drying at that time was performed at 160° C. The paper was processed by press nipping by a metal roll and an elastic roll to obtain a coated paper of a white paper glossiness of 45% and a basis weight of 84 g/m$^2$.

Example 2

The same procedure was followed as in Example 1, except for the point of changing the amount of Mirror-Gloss 91 in Example 1 from 5 parts to 60 parts, the amount of dispersant from 0.01 part to 0.08 part, and the amount of FMT-97 from 65 parts to 10 parts to prepare the pigment slurry, whereby a coated paper having a white paper glossiness of 70% and a basis weight of 84 g/m$^2$ was obtained.

Example 3

The same procedure was followed as in Example 2, except for the point of changing the amount of FMT-97 in Example 2 from 10 parts to 6 parts and adding 4 parts of a hollow organic pigment (product name: HP-1055, made by Rohm and Haas Japan) to prepare the pigment slurry and the point of changing the pressing nipping conditions, whereby a coated paper having a white paper glossiness of 70% and a basis weight of 84 g/m$^2$ was obtained.

Example 4

The same procedure was followed as in Example 3 except for the point of changing the pressing nipping conditions, whereby a coated paper having a white paper glossiness of 75% and a basis weight of 84 g/m$^2$ was obtained.

Example 5

The same procedure was followed as in Example 3 except for the point of changing the pressing nipping conditions, whereby a coated paper having a white paper glossiness of 80% and a basis weight of 84 g/m$^2$ was obtained.

Example 6

The same procedure was followed as in Example 3 except for the point of changing the pressing nipping conditions, whereby a coated paper having a white paper glossiness of 84% and a basis weight of 84 g/m$^2$ was obtained.

Example 7

The same procedure was followed as in Example 3, except for the point of changing the amount of thermoplastic organic microparticles with a Tg of 55° C. (product name: 0640, made by JSR) from 20 parts to 10 parts and adding 10 parts of thermoplastic organic microparticles with a representative Tg value of 46° C. (product name: L-8804, made by Asahi Kasei) to prepare the coating color, as well as the point of changing the pressing nipping conditions, whereby a coated paper having a white paper glossiness of 68% and a basis weight of 84 g/m$^2$ was obtained.

Example 8

The same procedure was followed as in Example 3, except for the point of changing the amount of Mirror-Gloss 91 in Example 3 from 60 parts to 55 parts to prepare the pigment slurry and changing the amount of thermoplastic organic microparticles (product name: 0640, made by JSR) from 20 parts to 10 parts, adding 10 parts of thermoplastic organic microparticles L-8804, and adding 5 parts of core/shell latex [the core having a Tg of −8° C. and the shell having a Tg of 18° C., product name: T-2530A, made by JSR] as an adhesive for reinforcing strength so as to prepare the coating color, as well as the point of changing the pressing nipping conditions, whereby a coated paper having a white paper glossiness of 75% and a basis weight of 84 g/m$^2$ was obtained.

Example 9

The same procedure was followed as in Example 3, except for the point of changing the amount of Mirror-Gloss 91 in Example 3 from 60 parts to 56 parts and adding 4 parts of crack formation promoting particles (precipitated calcium carbonate with an average particle size of 10 μm, made by Komesho Sekkai Kogyo Co., Ltd.) to prepare the pigment slurry and the point of changing the pressing nipping conditions, whereby a coated paper having a white paper glossiness of 72% and a basis weight of 84 g/m$^2$ was obtained.

Example 10

The same procedure was followed as in Example 3, except for the point of changing the amount of Mirror-Gloss 91 in Example 3 from 60 parts to 36 parts and adding 4 parts of crack formation promoting particles (precipitated calcium carbonate with an average particle size of 10 μm, made by Komesho Sekkai Kogyo Co., Ltd.) to prepare the pigment slurry and adding 20 parts of thermoplastic organic microparticles L-8804 so as to prepare the coating color, as well as the point of changing the pressing nipping conditions, whereby a coated paper having a white paper glossiness of 76% and a basis weight of 84 g/m$^2$ was obtained.

Example 11

The same procedure was followed as in Example 3, except for the point of changing the amount of Mirror-Gloss 91 in Example 3 from 60 parts to 70 parts and changing the amount of FMT-97 from 6 parts to 11 parts to prepare the pigment slurry and changing the amount of thermoplastic organic microparticles (product name: 0640, made by JSR) from 20 parts to 0 part and adding 5 parts of the adhesive T-2530A for reinforcing the strength so as to prepare the coating color, as well as the point of changing the pressing nipping conditions, whereby a coated paper having a white paper glossiness of 70% and a basis weight of 84 g/m$^2$ was obtained.

Example 12

The same procedure was followed as in Example 7, except for the point of changing the amount of Mirror-Gloss 91 in Example 7 from 60 parts to 20 parts, changing the amount of thermoplastic organic microparticles (product name: 0640, made by JSR) from 20 parts to 35 parts, and changing the amount of thermoplastic organic microparticles L-8804 from 20 parts to 35 parts to prepare the coating color and the point of changing the pressing nipping conditions, whereby a coated paper having a white paper glossiness of 80% and a basis weight of 84 g/m$^2$ was obtained. The coated paper obtained was good in other performance, but was somewhat inferior in ink transfer at the time of printing.

Example 13

[Preparation of Base Coated Paper]

7 parts of oxidized starch (product name: Ace A, made by Oji Corn Starch) as an adhesive and 3 parts of a core/shell latex [the core having a Tg of 2° C. and the shell having a Tg of 25° C.] (product name: T2531E, made by JSR) were added to 100 parts of acicular precipitated calcium carbonate (product name: TPX121, made by Okutama Kogyo) and further water was added to prepare a base coating color having a solids concentration of 45%.

The obtained coating color was coated on both surfaces of a paper substrate obtained in the same way as Example 1 so that the amount of dried coating per side became 3.0 g/m$^2$ to prepare a base coated paper.

[Preparation of One-Sided Two-Layer Composite]

A coating color prepared in the same way as in Example 2 was used as a topcoat coating color and coated on the base coat of the based coated paper on the both sides thereof, so as to give a dried coating amount per side of 8.5 g/m$^2$. The resulting paper was then press nipped to obtain a coated paper with a white paper glossiness of 68% and a basis weight of 83 g/m$^2$.

Comparative Example 1

The same procedure was followed as in Example 3 except for the point of changing the 10 parts of thermoplastic organic microparticles POT-7092 and the 20 parts of thermoplastic organic microparticles (product name: 0640, made by JSR) in Example 3 to 30 parts of the adhesive T-2530A, as well as the point of changing the press nipping conditions so as to obtain a coated paper having a white paper glossiness 70% and a basis weight of 84 g/m$^2$.

Example 14

[Preparation of Paper Substrate]

5 parts of precipitated calcium carbonate (PC, made by Shiraishi Calcium), 1.5 parts of starch, 0.1 part of alkenyl anhydrous succinic acid, and 0.6 part of aluminum sulfate were added to a pulp slurry of 90 parts of LBKP (Freeness (CSF)=450 ml) and 10 parts of NBKP (Freeness (CSF)=450 ml) to prepare a paper stock. Next, this paper stock was used to make paper by a fourdrinier paper machine. In the paper-making process, a size press device was used to coat starch to a dried mass of 1 g/m$^2$, then a machine calender was used to smooth the paper to a Bekk smoothness of 30 seconds, to thereby obtain a paper substrate having a basis weight of 65 g/m$^2$.

[Preparation of Coating Color for Inner Coating Layer]

10 parts of oxidized starch (product name: Ace A, made by Oji Corn Starch) as a water-soluble adhesive was added to 100 parts of acicular precipitated calcium carbonate (product name: TPX121, made by Okutama Kogyo) and further water was added to prepare a coating color having a solids concentration of 45%.

[Formation of Inner Coating Layer]

The above coating color was coated on both surfaces of the paper substrate using a gate roll coater at a coating rate of 500 m/min so as to give a dried coating amount per side of 1.0 g/m$^2$, whereby obtaining a coated paper with inner coating layers.

[Preparation of Coating Color for Outermost Coating Layer]

5 parts of kaolin (produce name: Mirror-Gloss 91, made by Engelhard Corporation) and 0.01 part of a dispersant (product name: Alon A-9, made by Toa Gosei Corporation) were added to water and dispersed by a Cowles disperser to obtain a kaolin dispersion in a solids concentration of 72%. 65 parts, by solids content, of 75% solids concentration ground calcium carbonate (product name: FMT-97, made by Fimatec Ltd.) was added to this dispersion to prepare a pigment slurry. 0.3 parts of carboxymethylcellulose (product name: AG gum HE No. 2, made by Daiichi Kogyo Seiyaku Co., Ltd.) and 30 parts of thermoplastic organic microparticles comprised of a styrene-butadiene-based copolymer with a Tg of 35° C. (product name: POT-7092, made by Nippon Zeon) were added to and mixed with this pigment slurry, and then water was added to prepare a coating color with a solids concentration of 55%.

[Formation of Laminated Coated Paper]

The above coating color for the outermost coating layer was coated on both surfaces of the coated paper having the above inner coating layer using a blade coater at a coating rate of 500 m/min so as to give a dried coating amount per side of 8.5 g/m$^2$. The paper was then processed by press nipping with a metal roll and an elastic roll to obtain a coated paper of a white paper glossiness of 70% and a basis weight of 84 g/m$^2$.

Example 15

The same procedure was followed as in Example 14, except for the point of using 30 parts of thermoplastic organic microparticles with a Tg of 55° C. (product name: 0640, made by JSR) instead of 30 parts of thermoplastic organic microparticles with a Tg of 35° C. (product name: POT-7092, made by Nippon Zeon) in the preparation of the coating color for the outermost coating layer, as well as the point of changing the pressing nipping conditions, whereby a coated paper having a white paper glossiness of 70% and a basis weight of 84 g/m$^2$ was obtained.

Example 16

The same procedure was followed as in Example 14, except for the point using 30 parts of thermoplastic organic microparticles with a representative Tg of 46° C. (product name: L-8804, made by Asahi Kasei) instead of 30 parts of thermoplastic organic microparticles with a Tg of 35° C. (product name: POT-7092, made by Nippon Zeon) in the preparation of the coating color for the outermost coating layer, as well as the point of changing the pressing nipping conditions, whereby a coated paper having a white paper glossiness of 70% and a basis weight of 84 g/m$^2$ was obtained.

Example 17

The same procedure was followed as in Example 14, except for the point of using 10 parts of thermoplastic organic microparticles with a Tg of 35° C. (product name: POT-7092, made by Nippon Zeon) and 20 parts of thermoplastic organic microparticles with a Tg of 55° C. (product name: 0640, made by JSR) instead of 30 parts of thermoplastic organic microparticles with a Tg of 35° C. (product name: POT-7092, made by Nippon Zeon) in the preparation of the coating color for the outermost coating layer, as well as the point of changing the pressing nipping conditions, whereby a coated paper having a white paper glossiness of 70% and a basis weight of 84 g/m$^2$ was obtained.

Example 18

The same procedure was followed as in Example 14, except for the point of using 30 parts of thermoplastic organic microparticles with a Tg of 75° C. (product name: S2577(A), made by JSR) instead of 30 parts of thermoplastic organic microparticles with a Tg of 35° C. (product name: POT-7092, made by Nippon Zeon) in the preparation of the coating color for the outermost coating layer, as well as the point of changing the pressing nipping conditions, whereby a coated paper having a white paper glossiness of 70% and a basis weight of 84 g/m$^2$ was obtained.

Comparative Example 2

The same procedure was followed as in Example 14, except for the point of using 10 parts of latex (product name: T2531E, made by JSR) as a water-dispersible adhesive instead of 10 parts of oxidized starch (product name: Ace A, made by Oji Corn Starch) as a water-soluble adhesive in the preparation of the coating color for the outermost coating layer, as well as the point of changing the pressing nipping conditions, whereby a coated paper having a white paper glossiness of 70% and a basis weight of 84 g/m$^2$ was obtained.

Comparative Example 3

The same procedure was followed as in Example 14, except for the point of using 30 parts of thermoplastic organic microparticles with a Tg of 0° C. (product name: T-2540A, made by JSR) instead of 30 parts of thermoplastic organic microparticles with a Tg of 35° C. (product name: POT-7092, made by Nippon Zeon) in the preparation of the coating color for the outermost coating layer, as well as the point of changing the pressing nipping conditions, whereby a coated paper having a white paper glossiness of 70% and a basis weight of 84 g/m$^2$ was obtained.

Example 19

The same procedure was followed as in Example 14, except for the point of changing the amount of ground calcium carbonate (product name: FMT-97, made by Fimatec Ltd.) from 65 parts to 62 parts and adding 4 parts of crack formation promoting particles (precipitated calcium carbonate with an average particle size of 10 μm, made by Komesho Sekkai Kogyo Co., Ltd.) in the preparation of the coating color for the outermost coating layer, as well as the point of changing the pressing nipping conditions, whereby a coated paper having a white paper glossiness of 70% and a basis weight of 84 g/m$^2$ was obtained.

Example 20

The same procedure was followed as in Example 14, except for the point of changing the amount of ground calcium carbonate (product name: FMT-97, made by Fimatec Ltd.) from 65 parts to 61 parts and adding 4 parts of a hollow organic pigment (product name: HP-1055, made by Rohm and Haas Japan) in the preparation of the coating color for the outermost coating layer, as well a the point of changing the pressing nipping conditions, whereby a coated paper having a white paper glossiness of 70% and a basis weight of 84 g/m$^2$ was obtained.

The coated papers obtained in Examples 1 to 20 and Comparative Examples 1 to 3 and the rotary offset printed matter and color copy printed matter of the same were evaluated by the following evaluation methods:

[Number of Cracks at Surface of Coating Layer]

The surface of the coated paper was evaluated by an electron microscope by a magnification of 100× or 500×, the number of cracks present in 100 mm$^2$ was investigated, and the number of cracks per mm$^2$ was calculated.

[Evaluation of White Paper Glossiness]

The white paper glossiness was measured under conditions of a light-incident and receipt angle of 75 degrees in accordance with JIS Z 8741. For the measurement, a Murakami Color Research Laboratory Glossiness Meter Model GM-26D was used.

[Evaluation of Air Permeability]

In accordance with the Japan TAPPI Pulp and Paper Testing Method No. 5-2:2000, Asahi Seiko full automatic digital Oken-type air permeability and smoothness tester EYO was used to measure the air permeability of the paper. The smaller the air permeability value (sec), the better the air permeability exhibited.

[Printing of Coated Paper]

[Rotary Offset Printing]

A rotary offset printing press (Mitsubishi Lithopia L-BT3-1100/made by Mitsubishi Heavy Industries, Ltd.) was used to print two sides with a four-color solid pattern at a printing speed of 600 rpm. The paper surface temperature at the drier outlet was made 120° C. 10° C. cooling water was passed through the cooling rolls after passing through the drier and the paper was folded continuously with the printing.

[Evaluation of Rotary Offset Printing Blisters]

The state of occurrence of blisters in rotary offset printed matter was visually judged and evaluated in five ranks of 1 to 5.

5: An extremely excellent level where blisters not observed at all.

4: An excellent level where blisters not observed almost at all.

3: A level free of problems in practice, where fine blisters observed in small amounts.

2: A level having problems in practice where blisters observed in large amounts.

1: A level having problems in practice, where large blisters observed in large amounts.

[Evaluation of Color Copy Blisters]

A Ricoh color copier IPSiO Color 2100 was used to continuously print 100 sheets of A4 size coated paper in color. The state of occurrence of blisters was visually judged and evaluated in five ranks of 1 to 5.

5: An extremely excellent level where blisters not observed at all.

4: An excellent level where blisters not observed almost at all.

3: A level free of problems in practice, where fine blisters observed in small amounts.

2: A level having problems in practice where blisters observed in large amounts.

1: A level having problems in practice, where large blisters observed in large amounts.

[Evaluation of Printing Finish]

The printing finish of the rotary offset printed matter was visually judged and evaluated in five ranks of 1 to 5.

5: An extremely excellent level.

4: A considerably excellent level.

3: A level free of practical problems, with minor inferior.

2: A level having problems in practice, with considerable inferior.

1: A level having problems in practice with great inferior.

[Evaluation of Rotary Offset Printing Wrinkles]

The state of occurrence of rotary offset printing wrinkles at a two-sided four-color solid printed part was visually judged and evaluated in five ranks of 1 to 5.

5: An extremely excellent level where occurrence of wrinkles not observed at all.

4: A excellent level where occurrence of wrinkles not observed almost at all.

3: A level free of problems in practice, where minor occurrence of wrinkles observed.

2: A level having problems in practice, where occurrence of wrinkles observed.

1: A level having problems in practice with significant wrinkles observed.

[Evaluation of Folding Cracks]

Printed coated paper was cut into an A4 size, folded into two by a paper folding machine (made by Polyzone Co., Ltd.) in an environment of a temperature of 20° C. and a humidity of 30% RH, examined at its bent part by a magnifying loupe, and evaluated in five ranks of 1 to 5.

5: Coating layer at bent part has no cracks or tears at all and is good.

4: Coating layer at bent part has almost no cracks or tears and is free of problems in practice.

3: Coating layer at bent part exhibits some cracks, but is free of problems in practice.

2: Coating layer at bent part exhibits cracks and tears and has problems in practice.

1: Coating layer at bent part exhibits cracks and tears, has pulp fibers of paper substrate exposed, and is remarkably inferior.

The results of the above evaluation are shown in Tables 1 and 2.

TABLE 1

| | Number of Cracks | Air Permeability | Rotary Offset Printing Bristers | Color Copy Bristers | Print Finishing | Rotary Offset Printing Wrinkles | Folding Cracks |
|---|---|---|---|---|---|---|---|
| Example 1 | 250 | 1000 | 5 | 5 | 4 | 5 | 3 |
| Example 2 | 200 | 1500 | 5 | 5 | 4 | 5 | 4 |
| Example 3 | 200 | 1500 | 5 | 5 | 4 | 5 | 4 |
| Example 4 | 210 | 1900 | 5 | 5 | 5 | 5 | 5 |
| Example 5 | 200 | 2400 | 4 | 4 | 5 | 5 | 5 |
| Example 6 | 230 | 2800 | 4 | 4 | 5 | 3 | 5 |
| Example 7 | 300 | 1300 | 5 | 5 | 4 | 5 | 4 |
| Example 8 | 400 | 1100 | 5 | 5 | 4 | 5 | 4 |
| Example 9 | 280 | 1300 | 5 | 5 | 4 | 5 | 4 |
| Example 10 | 250 | 1100 | 5 | 5 | 4 | 5 | 4 |
| Example 11 | 180 | 4000 | 3 | 3 | 4 | 4 | 4 |
| Example 12 | 500 | 1100 | 5 | 5 | 4 | 5 | 4 |
| Example 13 | 180 | 1500 | 5 | 5 | 4 | 5 | 5 |
| Comparative Example 1 | 1 | 30000 | 1 | 1 | 5 | 4 | 4 |

TABLE 2

| | Number of Cracks | Air Permeability | Rotary Offset Printing Bristers | Color Copy Bristers | Print Finishing | Rotary Offset Printing Wrinkles | Folding Cracks |
|---|---|---|---|---|---|---|---|
| Example 14 | 200 | 1900 | 4 | 4 | 5 | 4 | 3 |
| Example 15 | 350 | 1600 | 4 | 5 | 5 | 4 | 4 |
| Example 16 | 280 | 1800 | 4 | 5 | 5 | 4 | 3 |
| Example 17 | 420 | 1800 | 4 | 5 | 5 | 4 | 4 |
| Example 18 | 450 | 1400 | 4 | 5 | 5 | 4 | 4 |
| Example 19 | 600 | 1400 | 4 | 5 | 5 | 4 | 4 |
| Example 20 | 500 | 1500 | 4 | 5 | 5 | 4 | 4 |
| Comparative Example 2 | 190 | 2000 | 4 | 4 | 5 | 4 | 2 |
| Comparative Example 3 | 10 | 30000 | 1 | 1 | 4 | 1 | 1 |

The invention claimed is:

1. A coated paper comprised of a paper substrate, at least one surface of which is provided with at least one coating layer, characterized in that the surface of said coating layer has cracks of a width of 0.2 to 3.0 μm and a length of 3 to 1000 μm in an amount of 1 to 1000 cracks per $mm^2$;

wherein said surface of said coating layer has a white paper glossiness of 45 to 85% at a light-incident arid receipt angle of 75 degrees in accordance with JIS S 8741 and an Oken type air permeability of not more than 8000 sec. in accordance with the JAPAN TAPPI Pulp and Paper Testing Method No. 5-2:000; said coating layer contains thermoplastic organic microparticles having a glass transition temperature of 20 to 150° C.; and, 100 parts by mass of said coating layer contains 40 to 90 parts by mass of an inorganic pigment and 5 to 60 parts by mass of said thermoplastic organic microparticles.

2. The coated paper according to claim 1, wherein said coating layer contains crack formation promoting particles of an average particle size of 3.0 to 30.0 μm.

3. The coated paper according to claim 2, wherein 100 parts by mass of said coating layer contains 0.1 to 10 parts by mass of said crack formation promoting particles.

4. The coating paper according to claim 1 which comprises more than one coating layers, said layers comprise at least an inner coating layer adjoining said paper substrate and an outermost coating layer formed on said inner coating layer.

5. The coating paper according to claim 4, wherein said outermost coating layer contains 1 to 20 parts by mass of a non-film-forming hollow organic pigment in 100 parts by mass of the total pigment.

6. The coated paper according to claim 4 or 5, wherein said outermost coating layer contains crack formation promoting particles of an average particle size of 3.0 to 30.0 μm.

7. The coating paper according to claim 6, wherein 100 parts by mass of said outermost coating layer contains 0.1 to 10 parts by mass of said crack formation promoting particles.

8. The coated paper according to claim 4, wherein 100 parts by mass of said outermost coating layer contains 40 to 90 parts by mass of inorganic pigment and 5 to 60 parts by mass of thermoplastic organic microparticles.

9. The coated paper according to claim 8, wherein said thermoplastic organic microparticles have a glass transition temperature of 20 to 150° C.

10. The coated paper according to claim 8 or 9, wherein said thermoplastic organic microparticles comprise a styrene-butadiene copolymer.

11. The coated paper according to claim 4, wherein said inner coating layer contains a pigment having a crystal structure selected from the group consisting of acicular crystal, spindle-shape crystal, columnar crystal, and rice-shape granulated crystal.

12. The coated paper according to claim 1, wherein said inner coating layer contains starches.

13. A coated paper comprised of a paper substrate, at least one surface of which is provided with at least two coating layers, characterized in that an inner coating layer adjoining said paper substrate comprises a pigment having a crystal structure selected from the group consisting of acicular crystal, spindle-shape crystal, columnar crystal, and rice-shape granulated crystal, and an outermost coating layer formed on said inner coating layer comprises crack forming thermoplastic organic microparticles having a glass transition temperature of 20 to 150° C.

14. The coated paper according to claim 13, wherein said inner coating layer contains starches.

15. The coated paper according to claim 13, wherein said thermoplastic microparticles comprise a styrene-butadiene copolymer.

16. The coated paper according to claim 13, wherein said thermoplastic organic particle contains a non-film-forming hollow organic pigment, and 100 parts by mass of the total pigment of said outermost coating layer contains 1 to 10 parts by mass of said non-film-forming hollow organic pigment.

17. The coated paper according to claim 13, wherein said outermost coating layer comprises crack formation promoting particles.

18. The coated paper according to claim 17, wherein said crack formation promoting particles have an average particle size of 3.0 to 30.0 μm and are contained in an amount of 0.1 to 10 parts by mass in 100 parts by mass of said outermost coating layer.

19. The coated paper according to claim 13, wherein 100 parts by mass of said outermost coating layer contains 40 to 90 parts by mass of the inorganic pigment and 5 to 60 parts by mass of the thermoplastic organic microparticles.

20. The coated paper according to claim 13, wherein said outermost coating layer surface has cracks of a width of 0.2 to 3.0 μm and a length of 3 to 1000 μm. in an amount of 1 to 1000 cracks per $mm^2$.

21. The coated paper according to claim 13, wherein said outermost coating layer surface has a white paper glossiness of 45 to 85% at a light-incident and receipt angle of 75 degrees in accordance with JIS Z 8741 and an Oken type air permeability of not more than 8000 sec. in accordance with the Japan TAPPI Pulp and Paper Testing Method No. 5-2:2000.

* * * * *